United States Patent [19]

Kessler

[11] 4,150,612

[45] Apr. 24, 1979

[54] MEANS AND METHOD OF BUNDLING AND STACKING NEWSPAPERS AND THE LIKE

[76] Inventor: Ruth G. Kessler, 1730 Avenida Del Mundo, Coronado, Calif. 92118

[21] Appl. No.: 896,725

[22] Filed: Apr. 17, 1978

[51] Int. Cl.[2] ..... B65B 13/02

[52] U.S. Cl. ..... 100/2; 100/34

[58] Field of Search ..... 100/1, 2, 34; 214/10.5 R

[56] References Cited

U.S. PATENT DOCUMENTS

| | | | |
|---|---|---|---|
| 2,321,802 | 6/1943 | Deubener | 100/34 |
| 2,744,461 | 5/1956 | Genco | 100/34 |

*Primary Examiner*—Billy J. Wilhite

*Attorney, Agent, or Firm*—Knox & Knox

[57] ABSTRACT

A bundler and stacker for newspapers, magazines, books and the like characterized by economy in manufacture, collapsibility for shipping, ease and simplicity in use and automatic stacking of the bundles without lifting the bundles. The device is essentially an open-ended sleeve, rectangular in plan, and having divider means separating the sleeve into a lower portion which functions as a collar or support on a small starter bundle and on each succeeding bundle, and an upper portion functioning as a hopper or aligner for the newspapers as they are added and tied into bundles, the divider means being preferably flat members extending into and across the sleeve and being relied on to hold the sleeve in position while the hopper portion is being filled. The sleeve has means to hold bundle tying string or the like in the hopper while the same is being filled.

9 Claims, 6 Drawing Figures

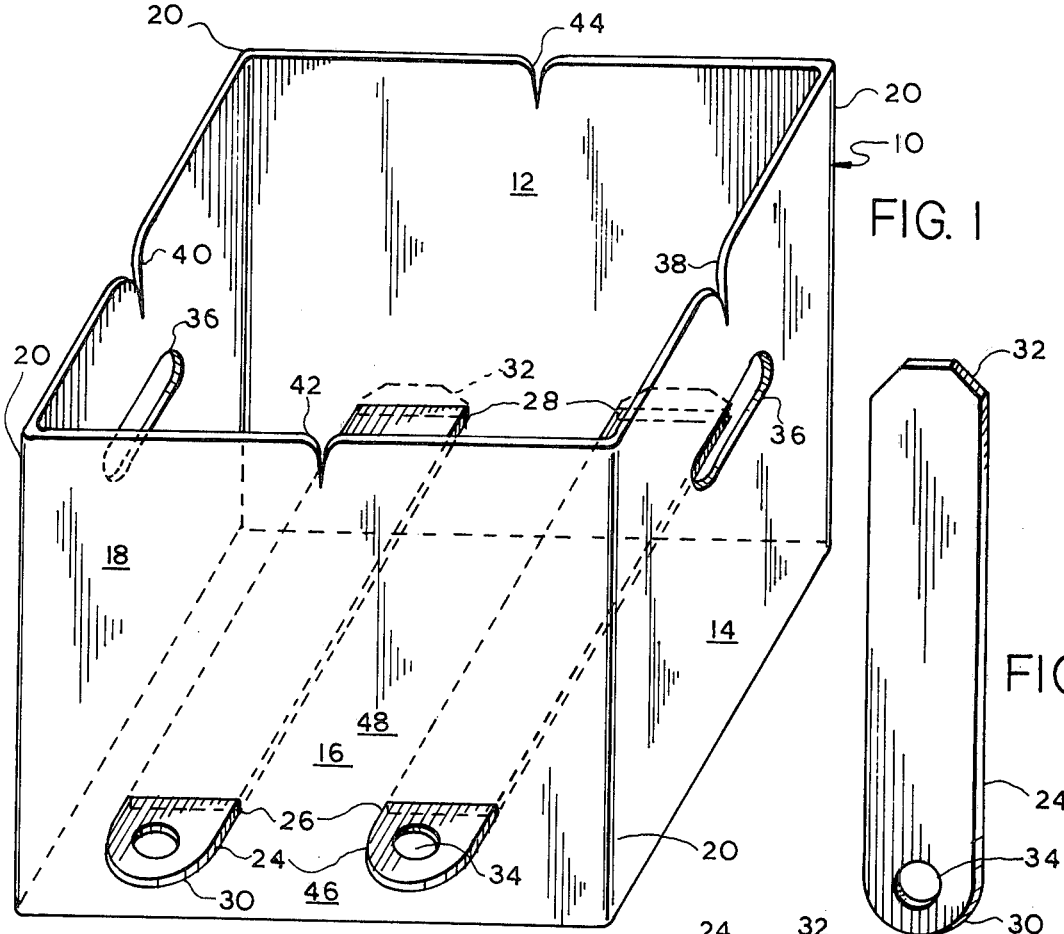
FIG. 1
FIG. 3
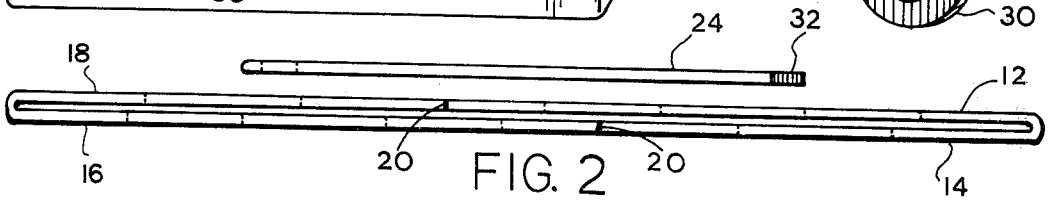
FIG. 2
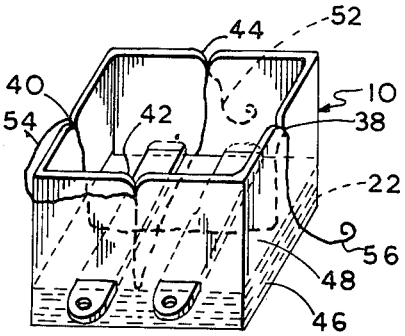
FIG. 4
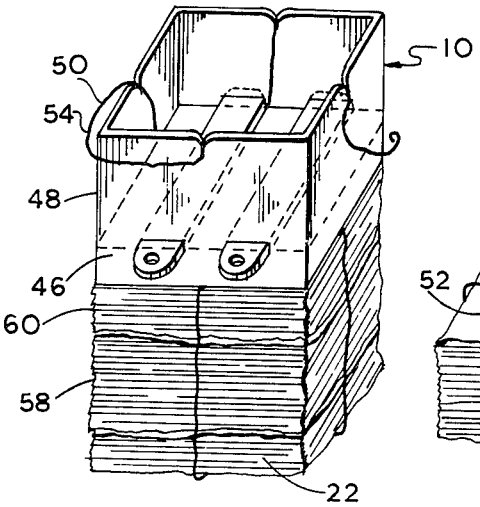
FIG. 5
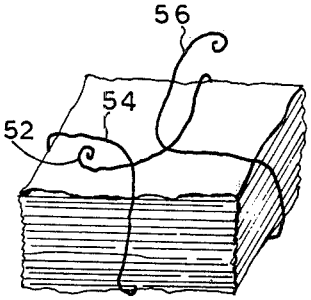
FIG. 6

MEANS AND METHOD OF BUNDLING AND STACKING NEWSPAPERS AND THE LIKE

BACKGROUND OF THE INVENTION

Reclamation and recycling of newsprint and the like has become quite important but the actual work of bundling and preliminary handling of used newspapers and other papers and the heavy bundles has discouraged office workers and householders and others from fully co-operating in such reclamation. Part of the problem is the difficulty experienced in tying and stacking the bundles. Boxes and cradles into which newspapers can be placed have been proposed and these can obviously be used successfully but such boxes and cradles have not fully solved the problem of extracting the tied bundle from such box or cradle, nor the problem of neatly and safely stacking the heavy bundles. There is a need therefore for a simple, effective means and method of bundling and stacking papers.

SUMMARY OF THE INVENTION

The present invention is an adequate response to the immediately abovementioned need, comprising a specific device and a corresponding method of slightly greater scope for collecting papers such as used newsprint, tying the same in bundles and stacking said bundles. The device comprises an open-ended, boxlike sleeve with means for dividing this sleeve into a guiding collar which embraces a small starter bundle or other suitable object, with the dividing means resting thereon and supporting an upper portion which functions as a hopper, rack or collector as well as holding twine or string to tie the accumulated papers into a bundle. Upon removal of the dividing means, the sleeve is raised, the dividing means re-inserted on top of the tied bundle and the process is repeated to build a stack of bundles without requiring lifting or moving the bundles as formed.

BRIEF DESCRIPTION OF THE DRAWING

FIG. 1 is an isometric view of the sleeve and dividing members in place;

FIG. 2 is a side elevation of the sleeve in collapsed position with a divider member thereabove;

FIG. 3 is an isometric view of one of the divider members;

FIG. 4 is a somewhat diagrammatic view of the apparatus of FIG. 1 with a starter bundle of papers indicated in dash line under the divider members, and with a single tie string in place and ready to receive papers in the upper or hopper portion;

FIG. 5 is a similar view illustrating further the structure and method, this figure showing the starter bundle and two further tied bundles in a stack formed according to this invention, and the device ready to receive further newspapers; and FIG. 6 is a diagrammatic view showing only the configuration of a single string on a bundle just prior to tying the knot, the bundle being shown separately for clarity.

DETAILED DESCRIPTION OF A PREFERRED EMBODIMENT

Referring now to the drawing wherein like numerals refer to identical or like parts throughout the different views, the invention comprises a method and apparatus reflecting the concept of a sleeve rather than a container, the sleeve 10 having an open top and bottom and having flat sides 12, 14, 16, and 18, which are vertical in use and which can be simple rectangular panels connected in box-like form. The panels are themselves substantially inflexible but at the four corners 20 the sleeve may be made freely flexible to allow collapsing the sleeve 10 into flat form as indicated clearly in FIG. 2, such flexibility at the corners being secured by scoring or the like when the sleeve is constructed of cardboard as is presently favored. Of course this collapsibility facilitates shipping and storage as well as mercantile and promotional display.

When this invention is to be used with newspapers the sides 12 and 16 are longer than the other parallel sides 14 and 18 in order to make the sleeve accommodate newspapers "flat folded" to half page size and a collapsible sleeve will be held expanded to rectangular form by a starter bundle 22. In such form, which will be assumed hereinafter in this description, dividing means comprising at least one and preferably two flat elongated members 24 are inserted through aligned slot apertures 26, 28 in the longer sides 12 and 16. These apertures 26 and 28 and elongated members 24 as illustrated are spaced upwardly from the bottom of the panels a distance of approximately three inches, the thickness of the starter bundle 22, this dimension being not particularly critical, and it is noteworthy that a box or block of any suitable material can be substituted for the starter bundle 22, if desired. The members 24 are smooth surfaced and terminally radiused or reduced as indicated at 30 and 32 to facilitate insertion, removal and re-insertion into the slot apertures 26, 28. Hand-hold means such as apertures 34 are provided in one end portion of each of the members 24, and hand-hold apertures 36 are also provided in the sides 14 and 18 of the sleeve 10.

Finally, in connection with the specific structure disclosed, the top edges of the sides 12–18 of the sleeve are provided with notches 38, 40, 42 and 44 terminating downwardly in slits to retain cord, twine or strong string, and this feature introduces a description of the herein claimed method of bundling and stacking papers.

The first step of the claimed method is providing a starter bundle 22 of papers, or a functional equivalent thereof, as illustrated in FIGS. 4 and 5. The sleeve 10 is then extended into rectangular form and the lower portion thereof is slipped down over said starter bundle to retain the sleeve in expanded, rectangular form. The member or members 24 are inserted through the sleeve, using slot apertures 26–28, above the starter stack 22 and ordinarily in contact therewith, thus dividing the sleeve 10 into a lower portion 46 embracing the starter bundle 22 and an upper portion 48 defining a hopper for additional newspapers. A single string 50, or an equivalent, is then led into and across the hopper as, for example, first into notch 38, then down inside the hopper and along the same and up the opposite side 18 to the notch 40, thence around a corner 20 exteriorly of the sleeve 10 to the notch 42, and interiorly down and across the hopper to notch 44, as best illustrated in FIG. 4. The hopper portion 48 is then filled with papers and the end portion 52 is looped through the exterior loop 54 of the string, the end portion 56 looped under the end portion 52 as indicated in FIG. 6 and the ends tied to create a tied bundle still within the hopper. Then the member or members 24 are withdrawn and the sleeve 10 raised the height of the tied bundle, and its steps beginning with re-insertion of the member or members 24 repeated to create a stack of bundles 58, 60 as indicated in FIG. 5, and of course further bundles to form a stack of the desired height.

The foregoing specific procedure is exemplary, especially in regard to the handling of the string, and is proposed as showing one complete method. Minor variations are proposed as within the spirit of this invention and the scope of the appended claims.

What I claim as new and desire to secure by letters patent, is:

1. Apparatus for bundling and stacking newspapers and the like, comprising:

(a) a rectangular box-like sleeve having an open top, an open bottom and flat vertical sides, said sleeve being dimensioned to frictionally embrace the sides of a bundle of newspapers;

(b) at least one member removably extending into said sleeve and operatively dividing said sleeve into a lower portion for engagement of a pre-bundled part of a stack, and an upper hopper portion to receive additional newspapers; and (c) means on said sleeve to retain a bundle tie string when said string is laid into and across said hopper portion, whereby when said hopper is filled the newspapers therein may be tied into a bundle, the said member removed, the sleeve raised, the said member replaced above the tied bundle and the operation repeated to form a stack of bundles.

2. Apparatus according to claim 1 wherein said box-like sleeve is collapsible into flat form for shipping and storage.

3. Apparatus according to claim 1 wherein said means to retain a bundle tie string comprises notches in the top of said sleeve tapering downwardly to slits for retention of various types and sizes of string.

4. Apparatus according to claim 3 wherein said notches are disposed centrally of the top of each side of the sleeve, so that a single string may be used to tie and cross-tie the bundles.

5. Apparatus according to claim 1 wherein said one member is duplicated and both members are flat and smooth surfaced.

6. Apparatus according to claim 5 wherein said members extend across the full width of said sleeve.

7. Apparatus according to claim 6 wherein said members have terminal hand-holds and said sides of the sleeve have hand-holds.

8. A method of bundling and stacking newspapers and the like, comprising:

(1) making a small stack of newspapers with the edges of the newspapers roughly defining four vertical sides of the stack;

(2) placing a four-sided sleeve over said stack in frictional contact with the four sides of the stack and extending thereabove to constitute a hopper;

(3) inserting a member through the sleeve above said stack to support the sleeve in said position;

(4) laying a string into and across the hopper;

(5) filling the hopper with additional newspapers;

(6) tying the additional papers into a discrete bundle;

(7) removing said member;

(8) raising said sleeve to re-define a hopper above the tied discrete bundle; and (9) repeating steps 3–8 till a stack of bundles of a desired height is obtained.

9. A method according to claim 8 wherein a single string is laid inside and along the sleeve, continued exteriorly of and around a corner of the sleeve, and then inside and across the sleeve, the string being held in position during the filling of the hopper by being inserted in notches in all four sides of the sleeve.

* * * * *